US008118334B2

(12) United States Patent
Ramsauer

(10) Patent No.: US 8,118,334 B2
(45) **Date of Patent: *Feb. 21, 2012**

(54) ADJUSTING DEVICE FOR ROTATING AND TILTING BOLTS

(76) Inventor: Dieter Ramsauer, Schwelm (DE)

( * ) Notice: Subject to any disclaimer, the term of this patent is extended or adjusted under 35 U.S.C. 154(b) by 1058 days.

This patent is subject to a terminal disclaimer.

(21) Appl. No.: 10/592,616

(22) PCT Filed: Mar. 3, 2005

(86) PCT No.: PCT/EP2005/002224

§ 371 (c)(1),
(2), (4) Date: Oct. 12, 2007

(87) PCT Pub. No.: WO2005/090723

PCT Pub. Date: Sep. 29, 2005

(65) Prior Publication Data

US 2008/0112774 A1 May 15, 2008

(30) Foreign Application Priority Data

Mar. 10, 2004 (DE) ..... 20 2004 003 708 U

(51) Int. Cl.
*E05C 5/04* (2006.01)

(52) U.S. Cl. ..... 292/251; 292/194; 292/197

(58) Field of Classification Search ..... 292/197, 292/257, 194, 251; 70/91, 127, 447; 411/273, 411/272, 935.1

See application file for complete search history.

(56) References Cited

U.S. PATENT DOCUMENTS

| | | | | |
|---|---|---|---|---|
| 3,373,648 | A * | 3/1968 | Pitzer | 411/24 |
| 4,371,547 | A * | 2/1983 | Munzenmaier et al. | 514/701 |
| 4,492,394 | A * | 1/1985 | Dignan | 292/64 |
| 4,679,835 | A * | 7/1987 | Weinerman et al. | 292/197 |
| 5,152,161 | A * | 10/1992 | Lee | 70/127 |
| 5,251,467 | A * | 10/1993 | Anderson | 70/370 |
| 5,491,993 | A * | 2/1996 | Anderson | 70/367 |
| 5,913,908 | A | 6/1999 | Czipri | |
| 5,961,162 | A * | 10/1999 | Glaser et al. | 292/198 |
| 6,428,060 | B1 | 8/2002 | Metz | |
| 6,568,226 | B1 * | 5/2003 | Ramsauer | 70/127 |
| 6,578,884 | B2 * | 6/2003 | Chiang | 292/66 |
| 7,441,427 | B2 * | 10/2008 | Vickers | 70/127 |
| 7,695,029 | B2 * | 4/2010 | Ramsauer | 292/67 |
| 2008/0018117 | A1 * | 1/2008 | Yeremian | 292/197 |

FOREIGN PATENT DOCUMENTS

| | | |
|---|---|---|
| DE | 198 03 372 | 8/1999 |
| FR | 2 715 428 | 7/1995 |
| WO | 00/31365 | 7/2000 |
| WO | 00/73605 | 12/2000 |
| WO | 01/70629 | 9/2001 |
| WO | 02/42588 | 5/2002 |

* cited by examiner

*Primary Examiner* — Kristina Fulton

(74) *Attorney, Agent, or Firm* — Frommer Lawrence & Haug LLP

(57) ABSTRACT

The description relates to an adjusting device for hook spindle rotating bolts, sash fastener rotating bolts, pull-turn bolts, swiveling bolts and the like of closures, particularly of closures for mounting in thin walls, such as sheet-metal cabinets with a frame and door, in which the closures have a closure driveshaft which is provided with an external thread and which holds a bolt so as to be axially adjustable, and/or a bolt which is provided with an internal thread or bore hole near its free end and which holds a back-engaging device so as to be adjustable perpendicular to the back-engagement plane. According to the invention, the rotating bolt carries or forms an internal thread for screwing in the closure driveshaft and one side of a coupling, such as a claw coupling, which acts by positive engagement, whose other side is held by the closure driveshaft so as to be rigid against rotation.

9 Claims, 4 Drawing Sheets

Fig.3A.
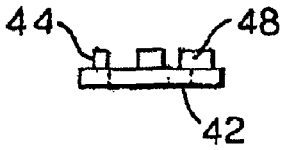
Fig.3B.
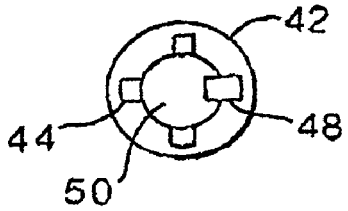
Fig.4A.
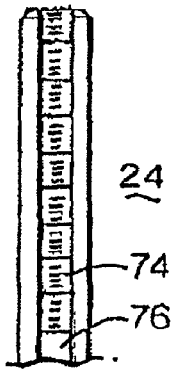
Fig.5.
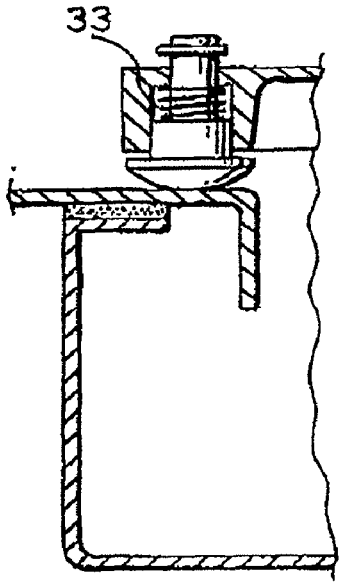
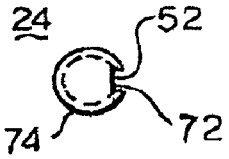
Fig.4B.
Fig.6.
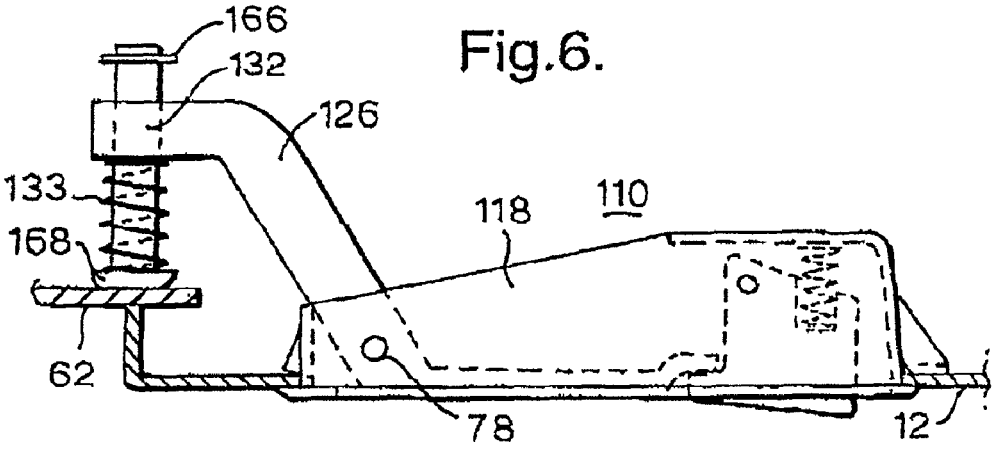

Fig.7A.
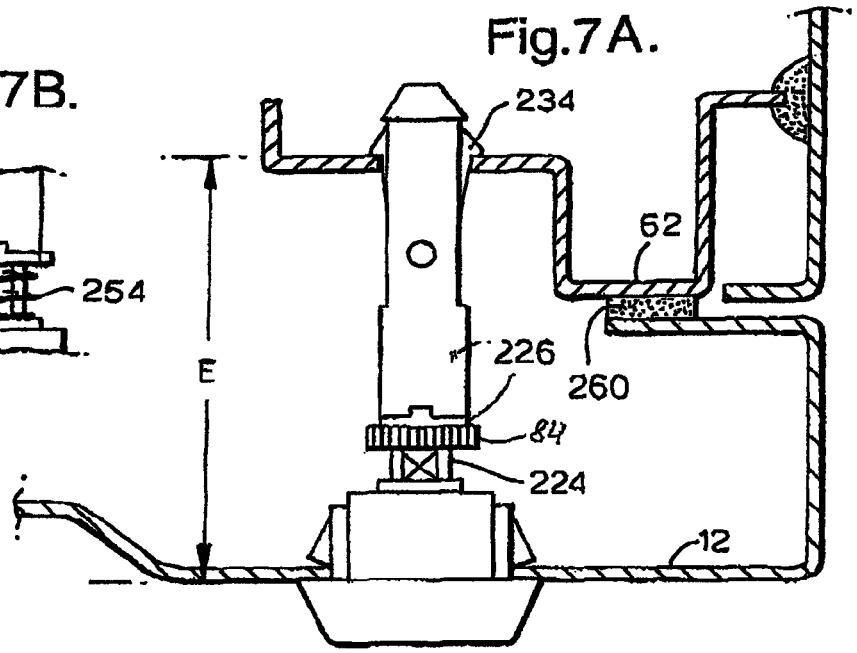
Fig.7B.
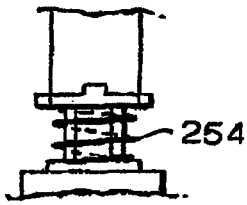
Fig.8A.
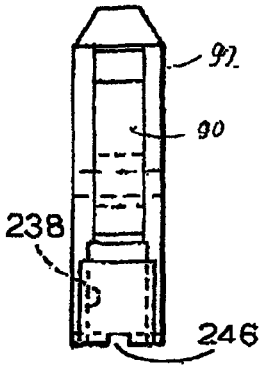
Fig.8B.
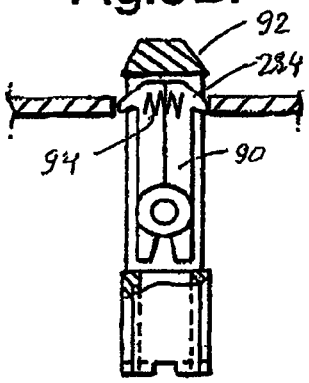
Fig.8C.
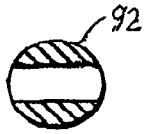
Fig.9A.
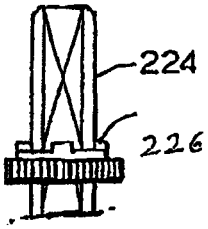
Fig.9B.
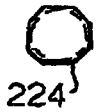
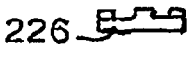
Fig.10A.
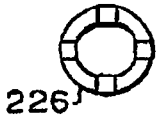
Fig.10B.

ADJUSTING DEVICE FOR ROTATING AND TILTING BOLTS

CROSS-REFERENCE TO RELATED APPLICATIONS

This application claims priority of International Application No. PCT/EP2005/002224, filed Mar. 3, 2005 and German Application No. 20 2004 003 708.4, filed Mar. 10, 2004, the complete disclosures of which are hereby incorporated by reference.

BACKGROUND OF THE INVENTION a) Field of the Invention

The invention is directed to an adjusting device for rotating and swiveling bolts. In particular, the invention relates to an adjusting device for hook spindle rotating bolts, sash fastener rotating bolts, pull-turn bolts, and swiveling bolts of closures, particularly of closures for mounting in thin walls, such as sheet-metal cabinets with a frame and door, in which the closures have a closure driveshaft which is provided with an external thread and which holds a bolt so as to be axially adjustable, and/or a bolt which is provided with an internal thread or bore hole near its free end and which holds a back-engaging device so as to be adjustable perpendicular to the back-engagement plane.

b) Description of the Related Art

WO 0179629A1 discloses a sash fastener rotating bolt closure which can be installed in a thin wall with the clamp device. The closure has a driveshaft which is provided with an external thread and at which a bolt is held by two lock nuts so as to be axially adjustable. For adjustment, it is necessary to loosen the two lock nuts, move the bolt into the desired position, and then tighten the lock nuts again. This is very complicated.

WO 00/31365 discloses a rotating bolt closure with a pull device in which the bolt is provided at its free end with an internal thread in which a rear-engagement device formed as a screw is held so as to be adjustable perpendicular to the back-engagement plane. Adjustment is again ensured by a lock nut. Also, adjustment is again complicated because a lock nut must be loosened, then the back-engaging device must be moved to the appropriate distance by turning, and then the lock nut must be tightened again.

WO 07/73605 shows a swivel lever closure in the drawing accompanying the Abstract. The swivel lever itself forms the back-engaging device. There is no possibility provided for adjustment.

WO 02/42588 A (RISI) shows an adjusting device for sash fastener rotating bolts, wherein the closure has a closure driveshaft (20) which is provided with an external thread and which holds a bolt or sash fastener (28) so as to be axially adjustable and which has a bolt (28) that is provided near its free end with an internal thread or bore hole. Holding devices, which force the bolt outward, and stop devices holding the bolt axially are provided.

Further, reference is had to U.S. Pat. No. 6,428,060 B1 (METZ) which discloses an adjusting device for rotating or swiveling bolts, wherein the closure has a closure driveshaft which is provided with an external thread and which holds a bolt so as to be axially adjustable and which has a bolt provided near its free end with an internal thread or bore hole. The bolt holds a back-engaging device (62) so as to be adjustable perpendicular to the back-engagement surface. The back-engagement surface has an external thread (63) for screwing into the thread of the free end of the bolt and a locking nut (67) which acts in a frictionally engaging manner (see FIGS. 1-3).

Finally, reference is had to U.S. Pat. No. 4,492,394 (DIGNAN ET AL.) (as prior art coming closest to the invention) which discloses an adjusting device for a sash fastener rotating bolt in which the closure has a closure driveshaft which is provided with an external thread and which holds a bolt so as to be axially adjustable and which has a bolt that is provided with an internal thread near its free end.

OBJECT AND SUMMARY OF THE INVENTION

It is the primary object of the invention to provide an adjusting device of the type mentioned above which can either be adjusted very simply and quickly.

The above-stated object is met according to an embodiment form in that the rotating bolt carries or forms an internal thread for screwing in the closure driveshaft and one side of a coupling such as a claw coupling which acts by positive engagement, whose other side is held by the closure driveshaft so as to be rigid against rotation.

Insofar as the driveshaft has a noncircular cross section and the portion of the claw coupling that is rigid against rotation with respect to the driveshaft has an opening which fits this cross section, it would be advantageous according to a further development of the invention to provide holding devices which press the coupling parts or coupling sides together. In particular, these holding devices can be formed by a spiral spring which is slid onto the shaft. The coupling part which contacts the spring can advisably have a projecting rim or grip collar to simplify handling.

However, the holding devices can also be a nut such as a knurled nut which is screwed onto the shaft.

The actuation shaft which is noncircular in cross section advisably has at least one axially extending flattened portion and this flattened portion advisably carries an adjusting graduation to facilitate handling and, in particular, to implement preadjustable distances.

Alternatively, the back-engaging device can be a head pin which is displaceable in the bolt against spring force. No adjustment at all is required; rather, the spring device provides for adapting in each instance to the distance between the door leaf on the one side and the back-engagement surface of the door frame on the other side.

To limit the movement of the pin due to spring force, it may be advantageous to provide a retaining ring device in the base of the pin.

In the present embodiment form, the coupling disk has four claws or projections/recesses arranged at intervals of ninety degrees. The opening of the locking disk and the cross section of the shaft can be shaped in such a way, for example, with four chords or flattened portions, that four positions which are offset by 90 degrees are formed between the locking disk on one side and the shaft on the other side, so that 90-degree locking is possible.

BRIEF DESCRIPTION OF THE DRAWINGS

The invention will now be explained more fully with reference to embodiment examples shown in the drawings.

FIGS. 3A and 3B show a side view and a top view of an adjusting ring with four catch positions;

FIGS. 4A and 4B show a side view and a cross-sectional view of a driveshaft which is provided with a slot and which also carries a graduation;

FIG. 5 shows a partial view of FIG. 1A to illustrate the pushed in state (closed position) of the closure;

FIG. 6 shows a side view of a swivel lever with adjusting device which is designed according to the invention;

FIG. 7A shows a side view of a quick adjustment of the distance of the frame from the door leaf provided in a hook spindle closure;

FIG. 7B shows a partial view of another embodiment form of the arrangement according to FIG. 7A;

FIGS. 8A, 8B and 8C show three views in a more detailed illustration of the hook spindle shown in FIG. 7A;

FIG. 9A shows a shape of the driveshaft that is suitable for the closures shown above;

FIG. 9B shows a side view through the shaft to illustrate the four flattened portions selected in this case which are spaced apart by 90 degrees;

FIGS. 10A and 10B show a side view and a top view of the locking disk used in FIG. 9A;

DESCRIPTION OF THE PREFERRED EMBODIMENTS

Figure 1A:
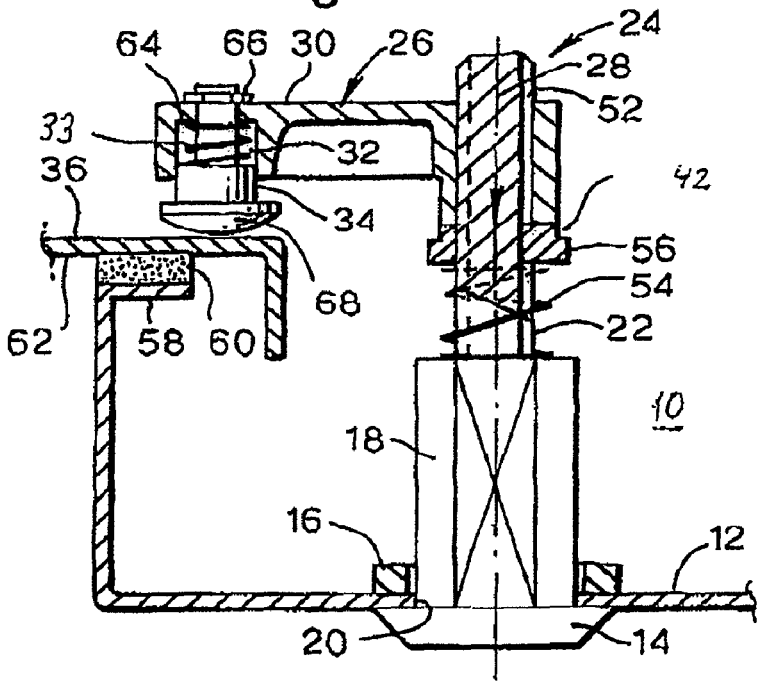
FIGS. 1A and 1B show a side view and a rear view of a pull-turn bolt with quick adjustment of the rotating bolt distance from the thin wall holding the closure.

FIG. 1A shows a pull-turn bolt closure 10 which is held in an opening 20 in a thin wall such as a door leaf 12 by its housing 18 which has a flange 14 and a coupling nut 16. The housing 18 holds a closure driveshaft 24 provided with an external thread 22 so as to be rotatable and displaceable to a limited extent. A bolt 26 is held on this closure driveshaft 24 so as to be adjustable in direction of the shaft axis 28. The bolt 26 shown here has, at its free end 30, a bore hole 32 with a back-engaging device 34 which is constructed as a pin and which is adjustable perpendicular to the back-engagement plane 36.

Figure 2A:
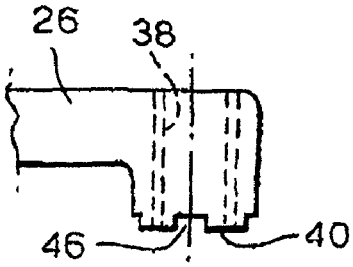
FIGS. 2A and 2B show a side view and a bottom view of the rotating bolt used in FIG. 1.
Figure 2B:
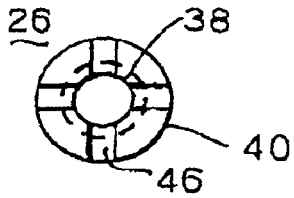

As is shown in FIG. 2A in a side view of a part of the rotating bolt 26, this rotating bolt 26 has an internal thread 38 for screwing in the closure driveshaft 24 by its thread 22. The bottom end of the thread according to FIG. 2A passes into a coupling side 40 which acts by positive engagement, while the other side of this coupling, which presents a claw coupling, forms a coupling disk 42 which is shown from the side in FIG. 3A and from the top in FIG. 3B. The coupling disk or locking disk 42 has projections or claws 44 which are arranged at a distance of 90 degrees relative to one another and which can engage in correspondingly arranged recesses 46 at the front surface or coupling side 40 of the bolt 26. The bolt 26 can therefore be locked in with respect to the disk 42 in steps of 90 degrees. The coupling disk 42 has a bore hole 50 which allows the closure driveshaft 24, including its thread, to project through, but wherein one of the projections 44 extends into the passage of this bore hole 50 (see reference number 48) so as to cooperate with an axial slot or groove 52 which is formed on the closure driveshaft 24. In this way, the locking disk 42 is axially displaceable but not rotatable with respect to the driveshaft 24. Therefore, when the coupling disk 42 is pushed against the coupling side 40 of the bolt 26, the latter is held in the position, and a spring 54 which is supported on the end of the housing 18 presses the disk 42 in this blocking function as can be seen in FIG. 1A. The coupling disk 42 forms a collar 56 so that it can be engaged by hand more easily and pushed downward against the force of the spring 54 to carry out an adjustment of the pull-turn bolt. While the disk 42 is held by the hand so as to be disengaged, the rotating bolt 26 can be turned around the driveshaft 24 and, accordingly, the distance of the back-engaging device 34 from the back-engagement surface 36 can be changed by means of the thread. When the proper adjustment is achieved, the locking disk 42 is released and engages again in the front side 40 of the rotating bolt 26, in which position the rotating bolt 26 is held so as to be rigid against rotation with respect to the shaft 24.

Figure 1B:
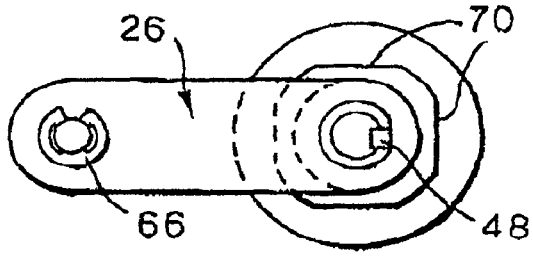

The adjustment is carried out in such a way that, with the pull-turn bolt 26 tightened, a door leaf 12 is pressed with its edge 58, possibly having a seal 60, e.g., against a frame 62 until the seal 60 closes. This state is shown in FIG. 5. The spring-loaded pin 34 enables a desired edge compensation and a self-adjusting compression of the seal 60. The spring 33 is supported on the head shoulder area of the pin 34 on one side and on a shoulder 64 formed by the bore hole 32 on the other side. The retaining ring 66 at the end of the pin 34 prevents the pin from falling out of the rotating bolt 26. The construction shown in FIGS. 1A and 1B accordingly enables a pre-adjustment by means of the thread 38 of the bolt 26 and a fine adjustment of height compensation by the displaceable arrangement of the back-engaging device 34 formed by the pin 34. It will be noted that the head of the pin is rounded, see reference number 68, so that it can also stop on the back-engagement area 36 in the partially tightened state.

The housing 18 has flattened portions 70 (preferably four pieces at intervals of 90 degrees) which cooperate with corresponding narrowed portions in the opening 20 of the door leaf 12 and accordingly enable mounting at intervals of 90 degrees so as to be rigid against rotation.

The groove 52 has a base with a surface 72, which base surface 72 can be used for arranging a graduation (see FIGS. 4A, 4B) which makes it possible to pre-adjust the bolt 26 on the shaft 24 prior to mounting in a cabinet.

When the driveshaft 24 is likewise provided with a flattened portion 70, it is possible to arrange another graduation 74 with better visibility than that arranged in the base surface 72 of the groove.

The special feature of the spring-loaded pin is also used in a swiveling bolt according to FIG. 6 which is not otherwise adjustable. The swivel bolt closure 110 shown in FIG. 6 comprises a housing 118 which can be snapped into an opening in a door leaf 12, A swivel bolt 126 which is swivelable around an axis, see 78, is arranged in the housing 118. The free end of the swivel bolt 126 also carries a bore hole 132 in which a head pin 168 is supported so as to be displaceable against the force of a pressure spring 133, wherein a lock washer 166 limits the thrust path.

The spring-loaded pin also results in a compensation of tolerances in case of imprecise manufacture and when sealing measures are undertaken.

Figure 11A:
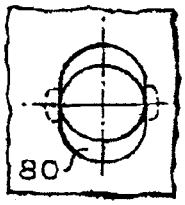
FIGS. 11A and 11B show a view of the lock opening with a non-linear cross section and the head of a hook spindle lock which is arranged in the lock opening.
Figure 11B:
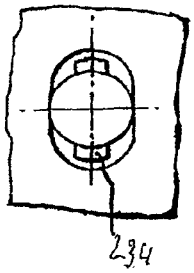

FIG. 7A shows the application of the fixing device according to the invention in a closure with a hook spindle device. A housing which is snapped into the door leaf 12 supports a shaft 224 on which the base of a hook spindle locking disk 226 is arranged. The spindle penetrates a bore hole or lock opening 80 (see FIGS. 11A and 11B) in the frame 62. In one position of the spindle (FIG. 11B), the hook 234 can pass through the opening 80, but in a position that is rotated by 90 degrees (FIG. 11A) it cannot. Accordingly, FIG. 11A shows the closed position and FIG. 11B shows the open position. Also, to compensate for tolerances required, for example, as a result of the seal 260, the hook spindle with its internal thread 238 can be screwed onto and off of the shaft 224 which is provided with an external thread so that the back-engagement surface of the hook 234 can be adapted more exactly with respect to the surface of the door leaf. A locking disk 226 can again be used to block the spindle in a certain position subsequently. This locking disk 226 is held either by a spring 254, according to FIG. 7B, or by a knurled nut 84, according to FIG. 7A, which can be screwed onto the thread of the driveshaft 224. Instead of a groove, the driveshaft 224 in this case has a noncircular outer cross section to which the inner cross section of the locking disk 226 is adapted so that the locking disk 226 can be slid axially back and forth on the shaft 224 but cannot rotate.

Figure 13B:
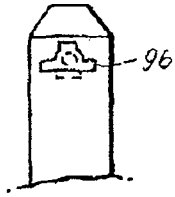
FIGS. 13A and 13B.
Figure 13A:
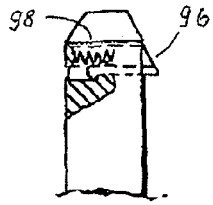
Figure 14:
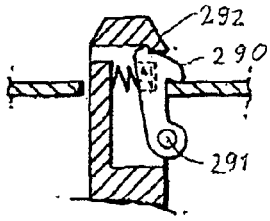
FIG. 14 show additional embodiment forms.

The hook 234 can extend outward rigidly or, in order to facilitate closing when the driveshaft is not in the closing position, can be constructed flexibly, e.g., by means of levers 90 which retract into the spindle 92 against spring force 94 according to FIGS. 8A, 8B and 8C, by means of slide arrangements 96 which are flexible against spring force 98 according to FIGS. 13A and 13B, and by means of a spindle 292 which has a fulcrum 291 for a level 290 according to FIG. 14.

Figure 12A:
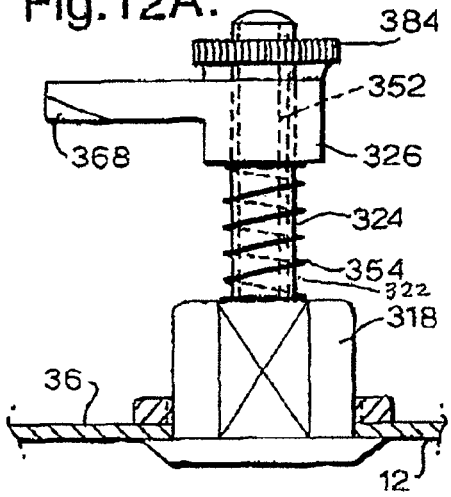
FIGS. 12A and 12B show a rotating bolt closure in which the tongue can be adjusted by a helix screw against spring force with respect to its height or its distance for mounting in the wall.
Figure 12B:
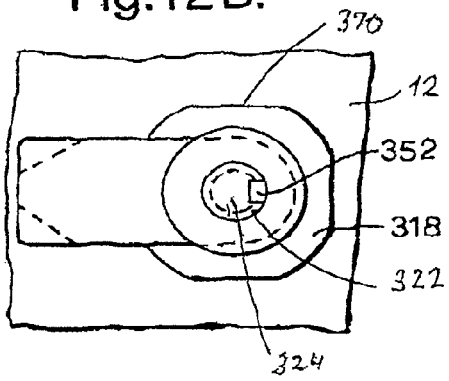

In the embodiment form shown in FIGS. 12A and 12B, a closure housing is held in a door leaf 12 by means of coupling nuts in a manner similar to that shown in FIG. 14. Flattened portions 370 prevent rotation in the opening in the thin wall 12. The housing 318 supports a driveshaft 324 on which a tongue 326 without a thread can slide axially but is fixed with respect to rotation, e.g., by means of a groove 352 in which a corresponding projection of the rotating tongue 326 engages. A pressure spring 354 which is supported at the housing 318 and which encircles the shaft 324 presses the tongue 326 against a knurled nut 384 which cooperates with a thread 322 on the shaft 324 and accordingly makes it possible to adjust the distance of the back-engagement surface 368 of the tongue from the door leaf plane 36.

Figure 12C:
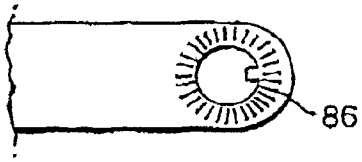
FIG. 12C shows a top view of the tongue.
Figure 12D:
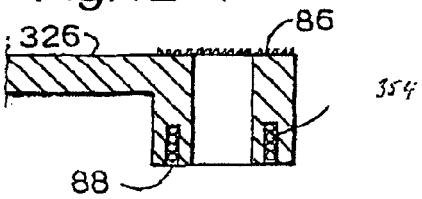
FIG. 12D shows an axial sectional view through the tongue.

The tongue 326 can have a toothing 86 according to FIGS. 12C, 12D which engages with a corresponding toothing of the knurled nut 384 for locking.

Further, according to FIG. 12D, the tongue can have a cylindrical groove 88 for receiving the compressed spring 324.

COMMERCIAL APPLICABILITY

The invention is commercially applicable in switch cabinet construction.

While the foregoing description and drawings represent the present invention, it will be obvious to those skilled in the art that various changes may be made therein without departing from the true spirit and scope of the present invention.

| Reference Numbers | |
|---|---|
| 10, 110 | pull-turn bolt closure |
| 12 | thin wall, door leaf |
| 14 | flange |
| 16 | coupling nut |
| 18, 318 | housing |

-continued

| Reference Numbers | |
|---|---|
| 20 | opening |
| 22, 322 | external thread |
| 24; 224, 324 | closure driveshaft |
| 26, 126, 226, 326 | bolt; hook spindle locking part; tongue; locking disk |
| 28 | shaft axis |
| 30 | free end |
| 32, 132 | bore hole |
| 33, 133 | spring; back-engaging device |
| 34, 234 | bolt, hook; back-engaging device |
| 36 | back-engagement plane |
| 38, 238 | internal thread |
| 40 | coupling side |
| 42 | coupling disk, locking disk |
| 44 | projection, claw |
| 46 | recess |
| 48 | projection |
| 50 | bore hole, opening |
| 52, 352 | groove |
| 54, 254, 354 | (spiral) spring, holding devices |
| 56 | collar |
| 58 | edge |
| 60, 260 | seal |
| 62 | frame |
| 64 | shoulder |
| 66, 166 | retaining disk |
| 68, 168, 368 | back-engaging device, rounded stop |
| 70, 370 | flattened portions |
| 72 | flattened portions, base surface |
| 74 | graduation, flattened portion |
| 76 | flattened portion |
| 78 | axis |
| 80 | bore hole |
| 82 | hook |
| 84, 384 | stop devices, nut, knurled nut |
| 86 | toothed surface (of the bolt) |
| 88 | cylindrical groove |
| 90, 290 | lever |
| 91, 291 | fulcrum |
| 92, 292 | spindle |
| 94 | spring force |
| 96 | slide arrangement |
| 98 | spring force |

The invention claimed is:

1. An adjusting device for rotating bolts of closures for mounting in a thin-wall door leaf and a door frame, comprising:

a closure driveshaft which is provided with an external thread;

a bolt which is axially adjustable along the driveshaft;

a coupling disk which couples the bolt and the driveshaft, the coupling disk being axially adjustable along the driveshaft and being rigid against rotation with respect to the driveshaft; and a holding device which presses the coupling disk against the bolt;

wherein said bolt is a rotatable bolt which has a mating internal thread for screwing in the closure driveshaft;

wherein the driveshaft has an axially extending groove that fits a projection part of the coupling disk to prevent the coupling disk from rotating;

wherein the bolt has a projection or recession that fits an engagement part of the coupling disk;

wherein the driveshaft has a noncircular cross section including a flattened portion;

wherein the holding device is formed by a spiral spring which is slid onto the driveshaft; and wherein the coupling disk which contacts the spring has a projecting rim.

2. The adjusting device according to claim 1;

wherein the holding device is formed by a nut which is screwed onto the driveshaft.

3. The adjusting device according to claim 1;

wherein the driveshaft has at least one axially extending flattened portion, and in that this flattened portion carries an adjusting graduation.

4. The adjusting device according to claim 1;

wherein the bolt includes a back-engaging device having a head pin which is displaceable in the bolt against spring force.

5. The adjusting device according to claim 4;

wherein a base of the head pin carries a retaining ring which limits a movement of the head pin due to spring force.

6. The adjusting device according to claim 1;

wherein the coupling disk has four elements which are projections and/or recesses, the elements being arranged at intervals of ninety degrees.

7. The adjusting device according to claim 6;

wherein the drive shaft is shaped to fit the four elements of the coupling disk.

8. The adjusting device according to claim 2;

wherein the bolt has a toothed surface which engages with a corresponding toothing of the nut.

9. The adjusting device according to claim 1;

wherein the bolt has a cylindrical groove for receiving a compressed spring.

* * * * *